United States Patent [19]

Yang

[11] Patent Number: 4,823,745

[45] Date of Patent: Apr. 25, 1989

[54] CONFORMABLE BLADDER ENGINE

[76] Inventor: Ping Yang, 1101 E. Garvey Ave., Suite 213, Monterey Park, Calif. 91754

[21] Appl. No.: 219,190

[22] Filed: Jul. 15, 1988

Related U.S. Application Data

[60] Division of Ser. No. 915,509, Oct. 6, 1986, which is a division of Ser. No. 753,670, Jul. 10, 1985, Pat. No. 4,651,690, which is a continuation-in-part of Ser. No. 646,773, Sep. 4, 1984, abandoned.

[51] Int. Cl.[4] ..... F01B 19/00

[52] U.S. Cl. ..... 123/51 R; 123/197 R; 60/530; 92/90; 418/156

[58] Field of Search ..... 123/19, 51 R, 65 R, 123/665, 197 R, 193 R, 47 R; 92/90, 142; 60/530; 418/153, 156

[56] References Cited

U.S. PATENT DOCUMENTS

| | | | |
|---|---|---|---|
| 2,658,486 | 11/1953 | Waide | 123/19 |
| 4,019,325 | 4/1977 | Murphy | 60/530 |
| 4,319,546 | 3/1982 | Beden | 123/19 |

FOREIGN PATENT DOCUMENTS

| | | | |
|---|---|---|---|
| 0060707 | 5/1980 | Japan | 60/530 |

*Primary Examiner*—David A. Okonsky

*Attorney, Agent, or Firm*—Cislo & Thomas

[57] ABSTRACT

This invention relates to an internal combustion engine comprising: a combustion chamber having at least one rigidly fixed inner wall surface and at least two movable inner wall surfaces reciprocally mounted and adapted to reciprocate from a first position lessening the internal volume of the combustion chamber to a second position expanding the internal volume of the combustion chamber; the two movable, inner wall surfaces are adapted to remain in the first position lessening the internal volume of the combustion chamber of a crankshaft means operatively attached to each of the movable, inner wall surfaces; a spark plug secured in the combustion chamber and having the spark gap terminals thereof extending into the combustion chamber; and a pair of inlet and exhaust valves disposed in the combustion chamber and opening inwardly thereinto complete the major components of the novel engine. In another embodiment, a conformable member is provided which acts upon a contained fluid to obtain work from the combustion of fuel. In yet another embodiment, the combustion chamber has at least three movable inner wall surfaces reciprocally mounted and adapted to reciprocally move as described above. Means are provided for translating the reciprocal linear motion of the walls into rotary motion suitable for coupling into a crankshaft.

3 Claims, 6 Drawing Sheets

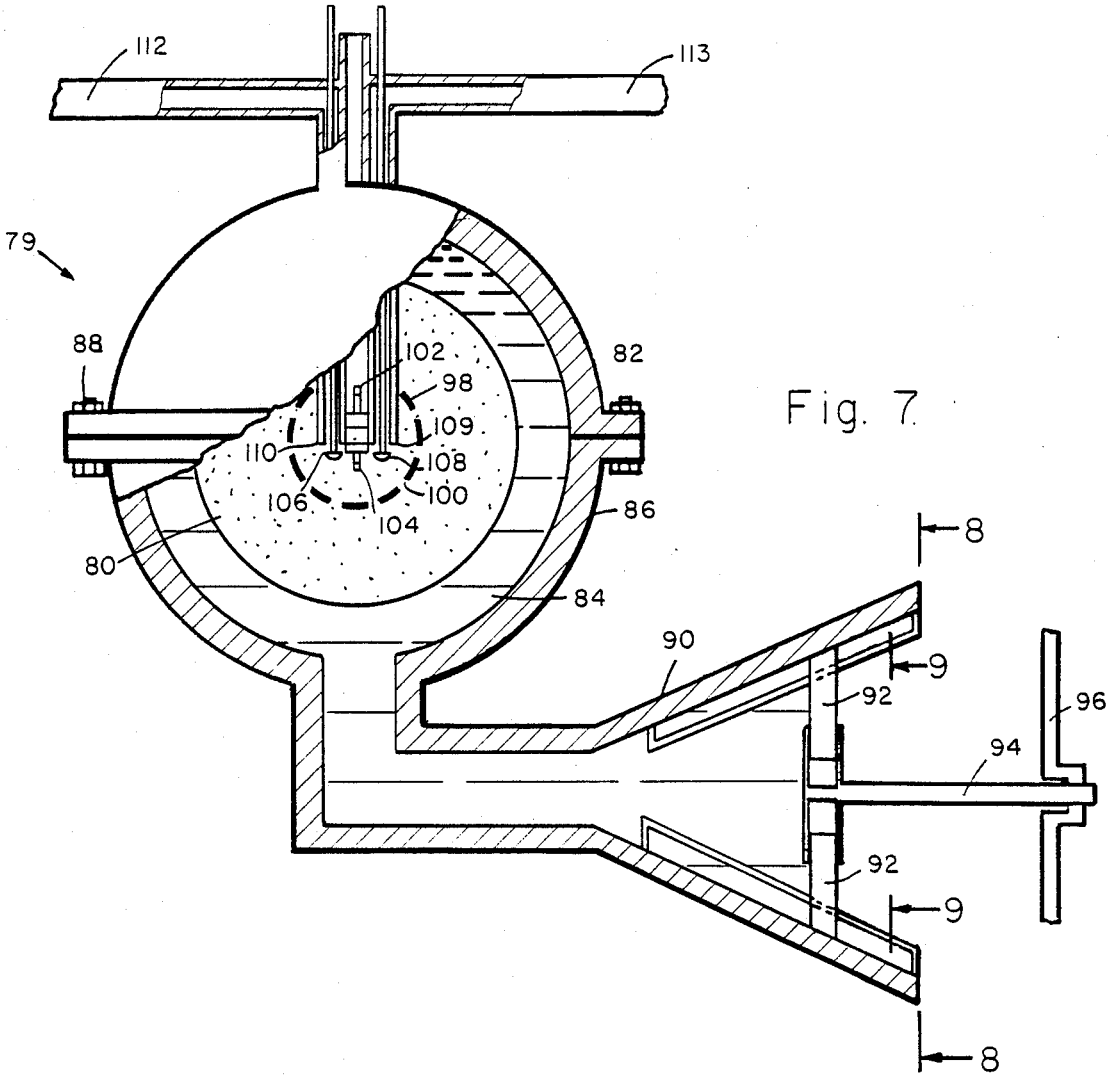
Fig. 7.
Fig. 8.
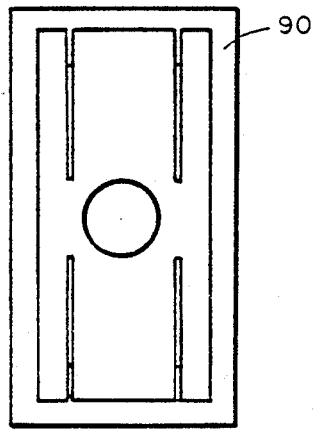
Fig. 9.
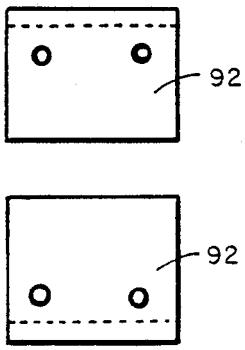

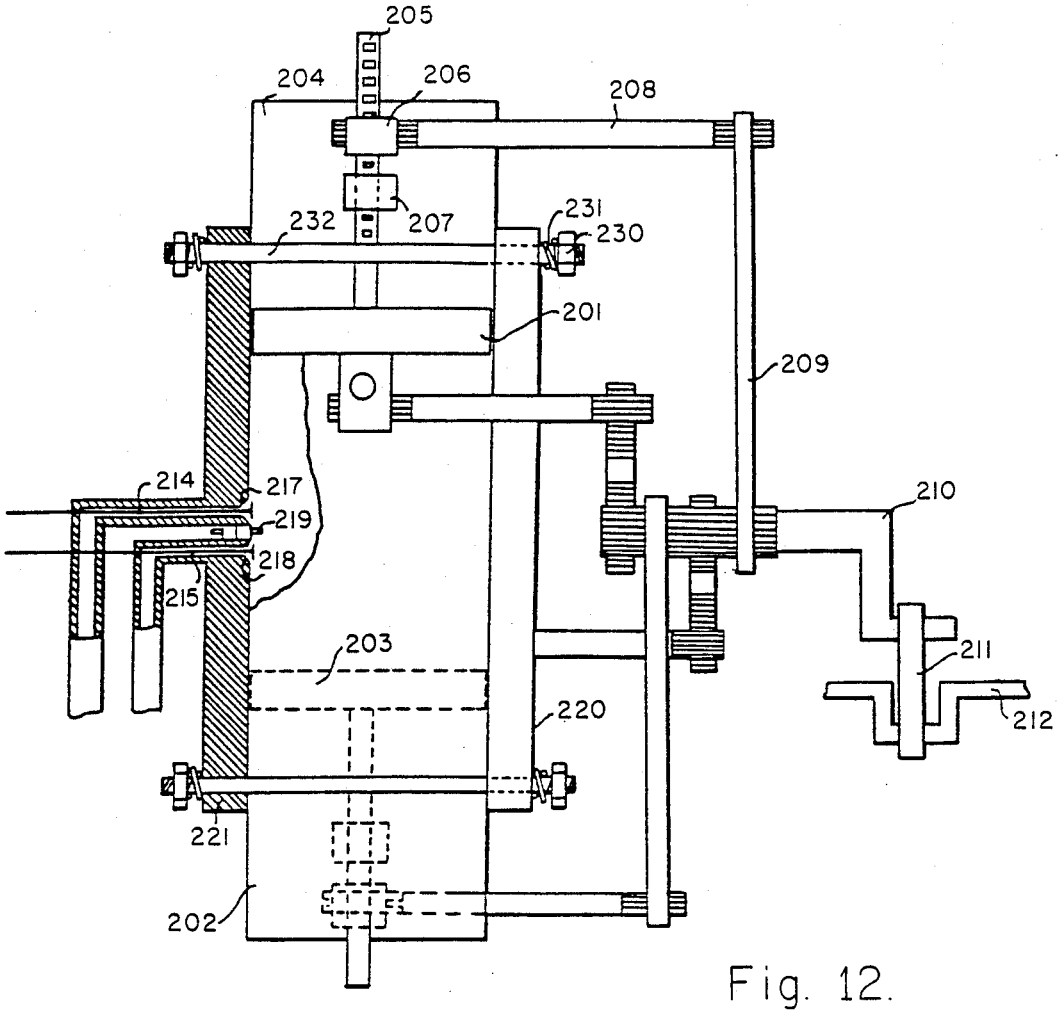
Fig. 12.
Fig. 13.
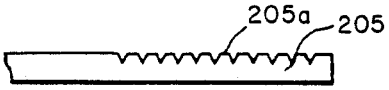
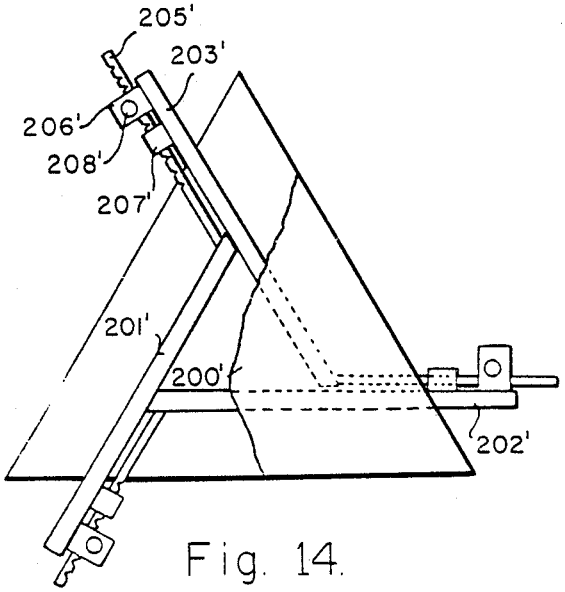
Fig. 14.

CONFORMABLE BLADDER ENGINE

CROSS-REFERENCE TO RELATED APPLICATIONS

The present patent application is a Divisional application of application Ser. No. 06/915,509 which in turn is a divisional application of Ser. No. 06/753,670 and now U.S. Pat. No. 4,651,690 which is a continuation-in-part application of Ser. No. 06/646,773, filed Sept. 4, 1984 and now abandoned.

BACKGROUND OF THE INVENTION

This invention relates to an internal combustion engine having at least two movable sidewalls in its combustion chamber that are acted upon by expanding gases in the combustion chamber to utilize the other-wise wasted energy of combusting forces which are not directional in the plane of the single piston taught in the prior art. In other words, in the usual internal combustion engine, having a combustion chamber formed from rigid sidewalls with only a single movable member acting as a piston to drive a crankshaft or like power train means, the movement of expanding gases normal to the axis of piston movement are wasted in that the energy exerted by these forces does not add to the downward force of gases expanding parallel the axis of piston movement. Thus, forces potentially additive to the harnessed downward driving force being exerted against the piston head are being wasted against the rigid sidewalls forming the combustion chamber. This invention harnesses these presently wasted forces by providing movable sidewalls acting as pistons in one or multiple planes so as to be acted upon by forces that are directed in planes other than unidirectionally downward.

U.S. Pat. No. 2,749,899 to Mitchell is representative of rigid, sidewall combustion chamber having only a movable piston, a spark plug adapted for ignition of gases in the combustion chamber and inlet and exhaust valves.

An internal combustion engine comprising three movable walls is disclosed in U.S. Pat. No. 3,692,005 to Buske. However, the construction of the engine disclosed in that patent is highly complex and involves the use of springs as countervailing forces against the pressure of expanding gases.

OBJECTS AND SUMMARY OF THE INVENTION

It is an object of the present invention to provide an internal combustion engine having greater efficiency than existing internal combustion engines.

It is another object of the present invention to provide an internal combustion engine that is economical in construction and in fuel usage.

It is yet another object of the present invention to provide an internal combustion engine that is relatively maintenance free and capable of easy maintenance when repair or adjustment becomes necessary to its continued operation.

It is still another object of the present invention to provide an internal combustion engine wherein the combustion chamber of the internal combustion engine has at least two movable sidewalls capable of independent reciprocal movement with respect to at least one rigidly fixed sidewall that is capable of greater efficiency by harnessing the otherwise wasted energy of combusting forces which are not directional along the longitudinal axis of the single piston taught in the prior art.

It is yet another, more important object of the present invention to provide an internal combustion engine wherein the combustion chamber of the internal combustion engine has at least three movable sidewalls capable of reciprocal movement.

It is a still further, more important object of the present invention to provide an internal combustion engine having comparatively simple means for translating the reciprocal motion of the sidewalls into rotary motion suitable for coupling into a crankshaft.

Briefly, the apparatus of the invention taught herein comprises in a first preferred embodiment, a combustion chamber having at least one rigidly fixed inner wall surface and at least two movable inner wall surfaces reciprocally mounted therein and adapted to reciprocate from a first position lessening the internal volume of the combustion chamber to a second position expanding the internal volume of the combustion chamber; ignition means secured in the combustion chamber adapted to selectively ignite a gas contained in the combustion chamber; and means for permitting the gas to selectively enter into and exit from the combustion chamber.

Another preferred embodiment of the apparatus of the invention comprises a combustion chamber having a rectangular shape and at least one rigidly fixed inner wall surface and three movable inner wall surfaces reciprocally mounted therein adapted to reciprocate from a first position lessening the internal volume of the combustion chamber to a second position expanding the internal volume of the combustion chamber; the three movable inner wall surfaces are cooperatively associated to remain in the first position lessening the internal volume of the combustion chamber by reason of their interconnection to a common crankshaft much like that found in the common piston, internal combustion engine; a spark plug secured in the combustion chamber and having the spark gap terminals thereof extending into the combustion chamber; and a pair of inlet and exhaust valves disposed in the combustion chamber and opening inwardly thereinto.

Still another preferred embodiment of an apparatus of the invention in the form of an internal combustion engine comprises; a combustion chamber formed by a conformable bladder member capable of expanding in conformance with internal combustive forces in an outward expanding direction and of returning to its original configuration thereafter; said bladder member is surrounded by a confined liquid medium contained in a closed receptable; piston means operatively connected to said closed receptacle activated by the pressure exerted through the liquid medium by said bladder member in its expanded state to move in reciprocal action capable of driving a crankshaft; a hollow casing received in the interior of said bladder member having a plurality of holes therethrough to permit outward expanding combustive forces to pass therethrough to expand said bladder member; ignition means secured in said hollow casing adapted to selectively ignite a gas contained in said combustion chamber; and means for permitting said gas to selectively enter into and exit from said combustion chamber.

Yet another preferred embodiment of the apparatus of the invention comprises a combustion chamber having at least three movable inner wall surfaces reciprocally mounted therein and adapted to reciprocate from the first position lessening the internal volume of the combustion chamber to a second position expanding the internal volume of the combustion chamber. Each wall surface is defined by a relatively thin rigid wall, one end of each wall being in slidable moving contact with an inner wall surface of an adjacent wall. An elongated extension is attached to the exterior of each movable wall, adjacent the wall-contacting end and extending substantially parallel to the adjacent inner wall surface. The elongated extension provides reciprocal linear motion in response to the movement of the wall to which it is attached. Means are provided on the adjacent inner wall surface for supporting the extension and for translating the reciprocal linear motion into rotary motion. Means are also provided for coupling the rotary motion derived from each of the movable walls into synchronous rotary motion, suitable for coupling to a crankshaft. Ignition means and inlet and exhaust means are also provided, as above.

These and other objects of the invention will become more apparent from the following commentary taken in conjunction with the following figures of drawings.

BRIEF DESCRIPTION OF THE DRAWINGS

FIG. 7 is a side, elevational cut-away view of yet another alternative embodiment of the apparatus of the invention;

FIG. 8 is a view taken along the line 8—8 of FIG. 7;

FIG. 9 is a view taken along the line 9—9 of FIG. 7;

FIG. 12 is a side, elevational cut-away view of the apparatus of FIG. 11;

FIG. 13 is an enlarged fragmentary view of a toothed, elongated member; and

FIG. 14 is a front, elevational cut-away view of an alternative embodiment similar to FIG. 11, but illustrating a triangular as opposed to a rectangular combustion chamber.

BRIEF DESCRIPTION OF THE PREFERRED EMBODIMENTS

Figure 1:
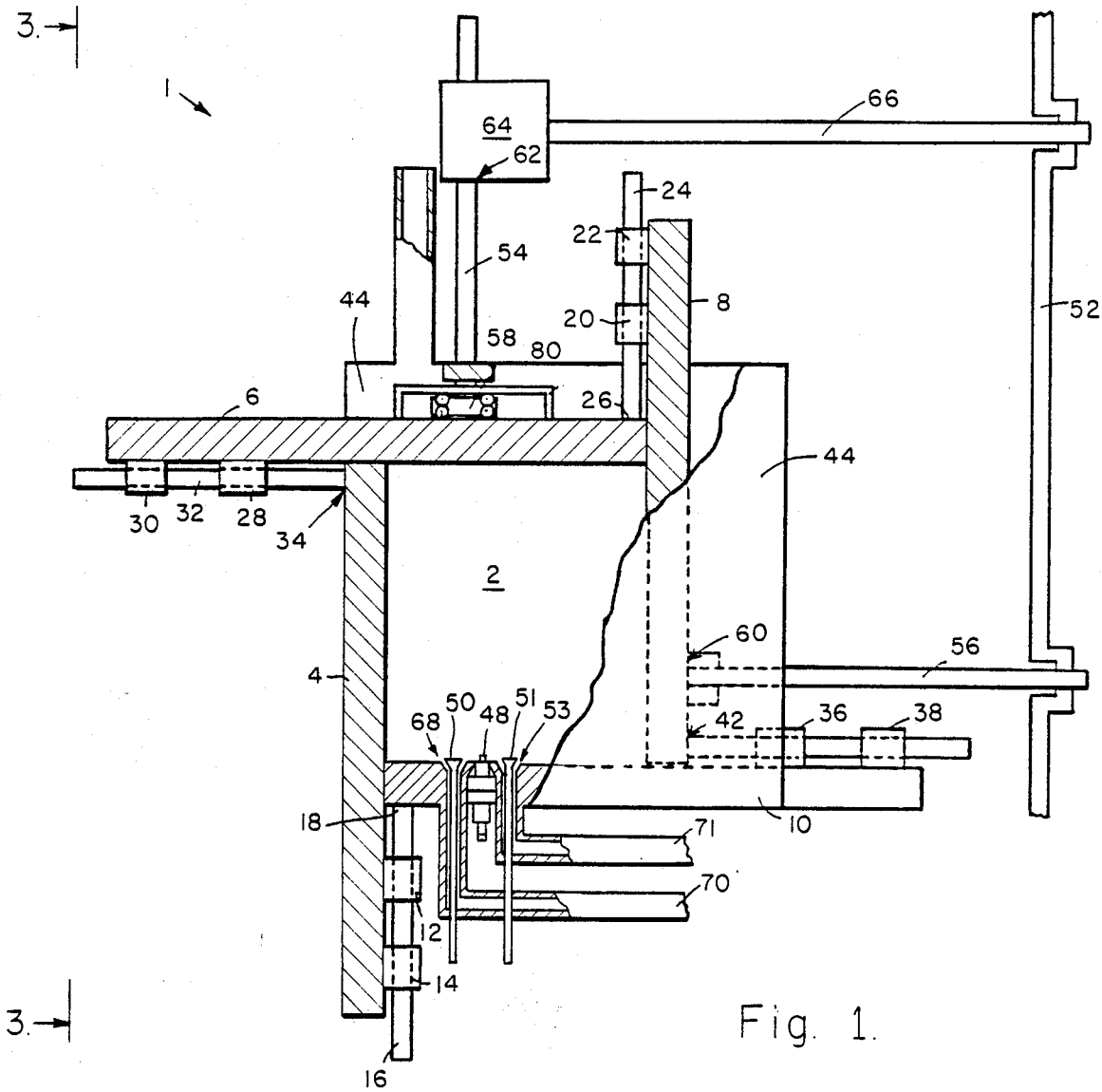
FIG. 1 is side perspective cut-away view of one combustion chamber of a preferred embodiment of the apparatus of the invention.

Referring to the figures of drawings wherein like numbers of reference designate like elements throughout, a preferred embodiment of an internal combustion engine 1 having a combustion chamber 2 constructed in accordance with the invention disclosed herein is shown in a fragmentary, sectional view of the combustion chamber 2 of engine 1. For ease of illustration and description, the drawings illustrate only the pertinent features of the present invention and do not show the remaining conventional features of the internal combustion engine 1, except as is apparent from FIG. 2.

Combustion chamber 2 is shown, but not limited to, being rectangular or any other polygonal configuration in general interior shape, here defined by generally planar sidewalls 4, 6, 8, and 10.

Sidewall 10 is rigidly connected to engine block 44, only partially shown in the drawings, and provides a stationary reference from which the below-described movement of sidewalls 4, 6 and 8 occurs.

Sidewall 4 is slidably joined to sidewall 10 by collars 12 and 14 receiving and retaining therethrough in slidable relation a metal rod 16 attached at one end 18 to sidewall 10. With this arrangement, sidewall 4 is capable of movement in the Y—Y axis, but is not capable of movement in the X—X axis.

Sidewall 6 is held in a sliding relationship to sidewall 8 by collars 20 and 22 receiving and retaining therethrough in slidable relation a metal rod 25 24 attached at one end 26 to sidewall 6. As with sidewall 4 described above, this arrangement permits sidewall 6 to move in the Y—Y axis.

Sidewall 6 is also slidably joined to sidewall 4 by collars 28 and 30 receiving and retaining therethrough in slidable relation a metal bar 32 attached at one end 34 to sidewall 4. The orientation of these elements enables sidewall 6 to move in the X—X axis.

At this point it must be noted that the collars and metal bar arrangements described above, cooperate to enable sidewall 6 freedom of movement in both the X—X axis. Sidewall 10 remains stationary with regard to engine block 44 to act as a reference frame. Sidewall 4 retains freedom of movement only in the Y—Y axis.

An ignition means to selectively ignite gases placed in combustion chamber 2 is provided by a spark plug 46 secured in sidewall 10 and having the spark gap terminals 48 thereof extending through sidewall 10 and into combustion chamber 2.

A means to permit gases to selectively enter and exit from combustion chamber 2 is provided by a pair of inlet and exhaust valves 50 and 51 respectively, disposed in sidewall 10 and opening inwardly through sidewall 10 to provide an inlet and an exhaust port for gases contained in combustion chamber 2.

Figure 2:
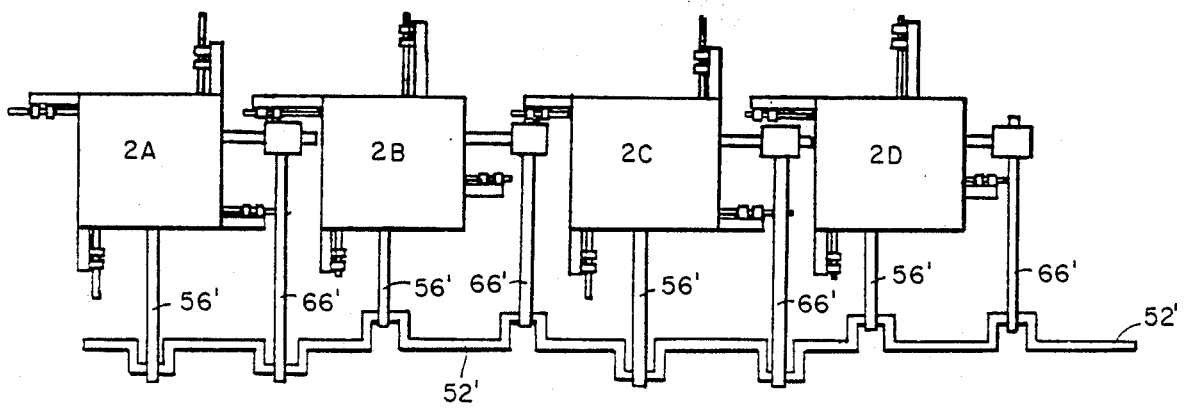
FIG. 2 is a schematic illustration depicting a series of combustion chambers of the invention operatively associated with a crankshaft.
Figure 3:
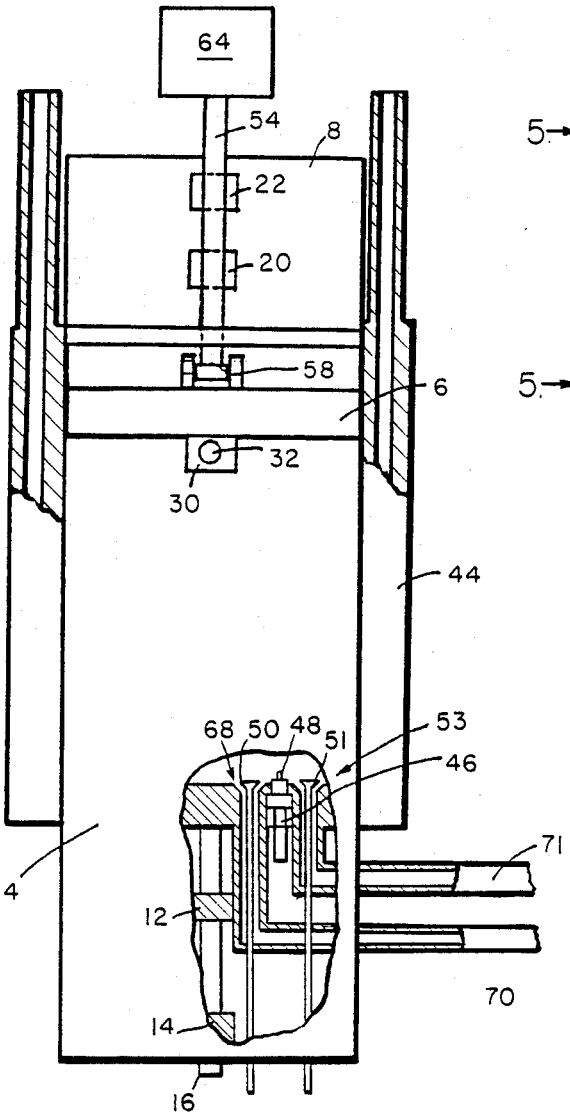
FIG. 3 is a view taken along the line 3—3 of FIG. 1.
Figure 4:
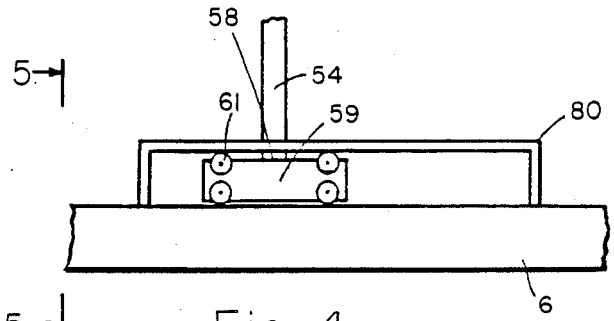
FIG. 4 is an enlarged fragmented view of the wheeled movable member shown in FIG. 3.
Figure 5:
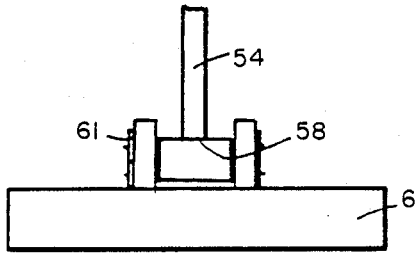
FIG. 5 is an enlarged view taken along the line 5—5 of FIG. 4.

Referring to FIG. 2, the intake, compression, combustion and exhaust cycles of the combustion chamber will readily become apparent. Therein the combustion chambers 2 (herein designated in order and sequence of firing as 2-A, 2-B, 2-C, and 2-D) have the movable sidewalls as previously described operating associated with crankshaft 52' through drive rods 56' and 66'. Thus, when chamber 2-A is in the combustion cycle, chamber 2-B is in the compression cycle, whereas chamber 2-C is in the intake cycle and chamber 2-D is in the exhaust cycle.

Therefore, the movable walls 4 and 8 will be positioned as dictated by the cycle state for the particular combustion chamber 2 that they are associated with. In this regard, the movable walls 4 and 8 cooperate, much like the pistons in a conventional internal combustion engine, through the common crankshaft 52'.

For example, operation of the crankshaft 52 urge sidewall 6 downward toward sidewall 10, thereby lessening the internal volume of combustion chamber 2 and compressing any gases contained therein.

Similarly, sidewall 8 is urged toward sidewall 4, thereby lessening the internal volume of combustion chamber 2 even further and compressing any gases contained therein to an even higher degree preparatory to ignition of the gases in combustion chamber 2.

The translatory member 58 comprises a means whereby movement of wall 6 is obtained in both X—X and Y—Y axes. Member 58 has roller member 59 supported by rollers 61 inwardly spaced of guides 80.

While the essential elements and their characteristics of a preferred embodiment are described above, the drawings also illustrate how combustion chamber 2 may be operatively adapted to power a crankshaft 52.

Referring to FIGS. 1 and 2, drive rods 54 and 56 are each operatively and pivotably connected at one end 58 and 60 to movable sidewalls 6 and 8, respectively.

Drive rod 56 is shown directly connected to crankshaft 52 in a conventional manner. Similarly, drive rod 54 has its end 62 operatively engaging a gear box 64 adapted to redirect the direction of the thrust exerted by drive rod 54 to drive rod 66 which, in turn, operatively engages drive shaft 52 in a conventional manner similar to drive rod 56.

From the above description, it should be readily apparent that the apparatus of the invention described may be used as follows:

Inlet value 50 opens to provide an inlet port 68 for a combustible gas to enter combustion chamber 2 15 via feed hose 70 and then closes to contain the gas in combustion chamber 2.

Sidewalls 4, 6 and 8 are urged toward rigid reference sidewall 10 to lessen the internal volume of combustion chamber 2, thus compressing the contained gas. Spark plug 46 now causes a spark across its spark gap terminals 48 which extend through sidewall 10 and into combustion chamber 2. The combustible gas ignites and forces movable sidewalls 4, 6 and 8 outward from stationary reference sidewall 10. Drive rods 54 and 25 56, attached to sidewalls 6 and 8, respectively, are activated by the movement of the sidewalls to rotate crankshaft 52.

After this expanding power cycle is complete, the continued crankshaft movement urges movable sidewalls 4, 6 and 8 toward sidewall 10, lessening the internal volume of combustion chamber 2. Simultaneous with this inward movement, exhaust valve 51 opens to provide an exit port 53 for the now combusted gas to allow it to exit the engine system via exhaust pipe 71, thereby completing the cycle of the engine.

Once exhausted, inlet valve 50 opens to provide an inlet for more combustible gas to enter the system and begin the entire sequence again.

Figure 6:
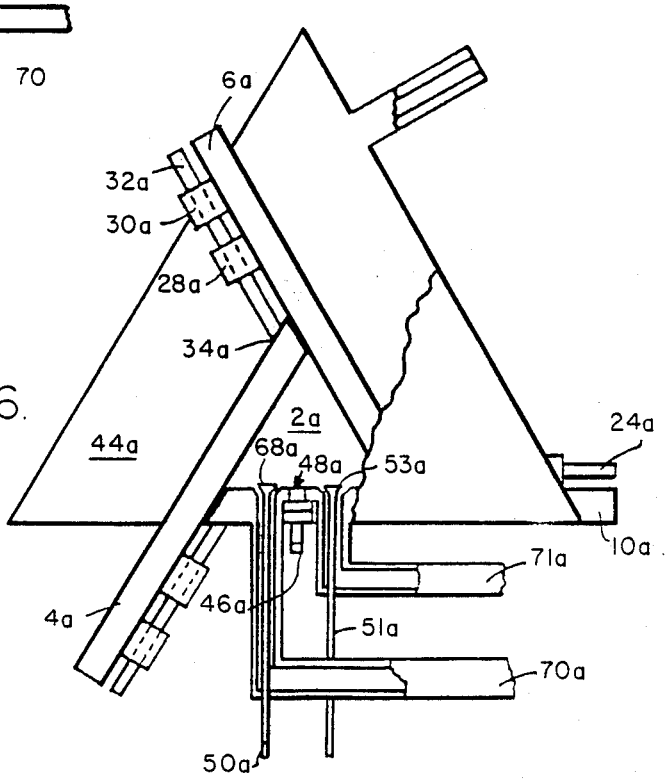
FIG. 6 is a side, elevational cut-away view of an alternative embodiment of the apparatus of the invention.

Other preferred embodiments of the apparatus of the invention would include having the combustion chamber constructed in the form of a prism-shaped enclosure as is shown in FIG. 6, wherein numbers 1*a* through 71*a* inclusive are similar to those elements designated by numbers 1 through 71 described above.

FIG. 7 shows still another embodiment of an internal combustion engine 79 constructed in accordance with the present invention.

Combustion chamber 80 is formed by conformable bladder member 82 capable of expanding in conformance with internal combustive forces moving in an outward direction and also capable of contracting inwardly thereafter to its original shape. The bladder member 82 in some instances may also be expansible where the material of construction permits.

Bladder member 82 is substantially surrounded by a confined liquid medium 84 contained in a closed receptable 86. While receptable 86 is shown to be globe-like in FIG. 7, its shape may be varied to better accommodate the actual operating environment in which engine 79 is to be utilized. It is also suggested in FIG. 7 by bolts 88, that receptacle 86 should be constructed in sections so as to permit easy access to its interior for maintenance and repair purposes.

Receptacle 86 is shown in FIG. 7 to be formed having a channel 90 to accommodate piston means 92 which is connected to drive shaft 94 and thereby to crankshaft 96 in a commonly understood fashion.

A hollow casing 98 is received in the interior of bladder member 82 and has a plurality of holes 100 therethrough to permit outward expanding combustive forces to pass therethrough to expand bladder member 82.

An ignition means to selectively ignite gases placed in combustion chamber 80 is provided by a spark plug 102 secured in hollow casing 98 and having the spark gap terminals 104 thereof extending into the interior of hollow casing 98 and into bladder member 82. A means to permit gases to selectively enter and exit from combustion chamber 80 is provided by a pair of inlet and exhaust valves 106 and 108, respectively, disposed in hollow casing 98 and opening inwardly into bladder member 82 to provide an inlet and an exhaust port for gases contained in combustion chamber 80.

This alternate embodiment of the invention operates in the following manner:

Inlet valve 106 opens to provide an inlet port 110 for a combustible gas to enter combustion chamber 80 via feed hose 112 and then closes to contain the gas in combustion chamber 80.

Bladder member 82 is in its contracted state, thus containing the combustible gas in a small volume. Spark plug 102 now causes a spark across its spark gap terminals 104 which extend into the interior of hollow casing 98 and thus into the interior of bladder member 82. The combustible gas ignites and forces bladder member 82 to expand outward, thus exerting pressure on piston means 92 through liquid medium 84. Drive shaft 94, attached to piston means 92, is activated by the pressure transmitted through liquid medium 84 to rotate crankshaft 96.

After this expanding force is dissipated and this portion of the power cycle is completed, bladder member 82 begins to resume its normal state. Simultaneous with this, exhaust valve 108 opens to provide an exit port 109 for the now combusted gas to allow it to exit the engine system via exhaust pipe 113, thereby completing the cycle of the engine.

Once exhausted, inlet valve 106 opens to provide an inlet for more combustible gas to enter the system and begin the entire sequence again.

Figure 10:
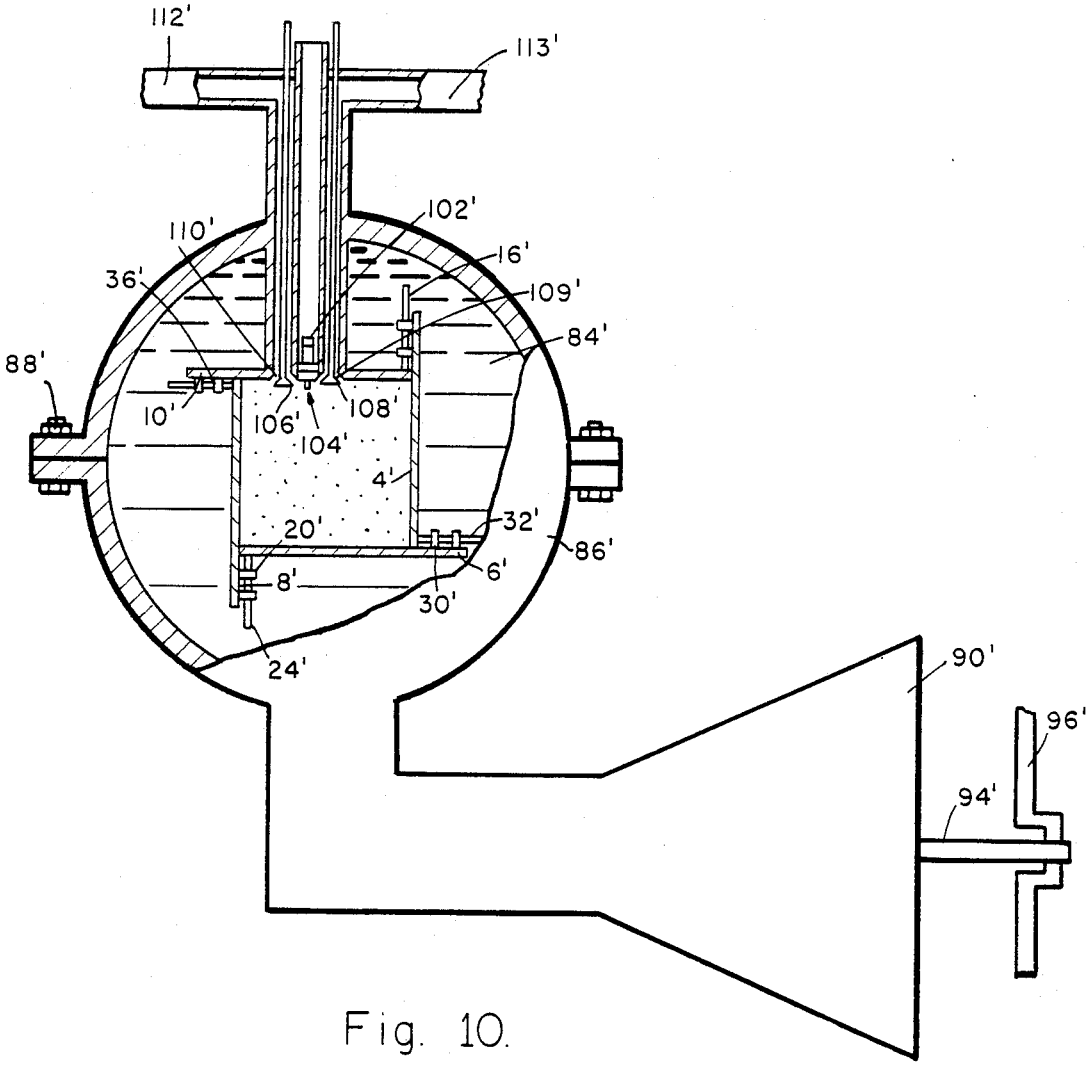
FIG. 10 is a side, elevational view of an alternative embodiment similar to FIG. 9, but illustrating a rectangular as opposed to a spherical combustion chamber.

FIG. 10 illustrates the engine of the invention, similar to that depicted in FIG. 9 except that the combustion chamber is rectangular.

Figure 11:
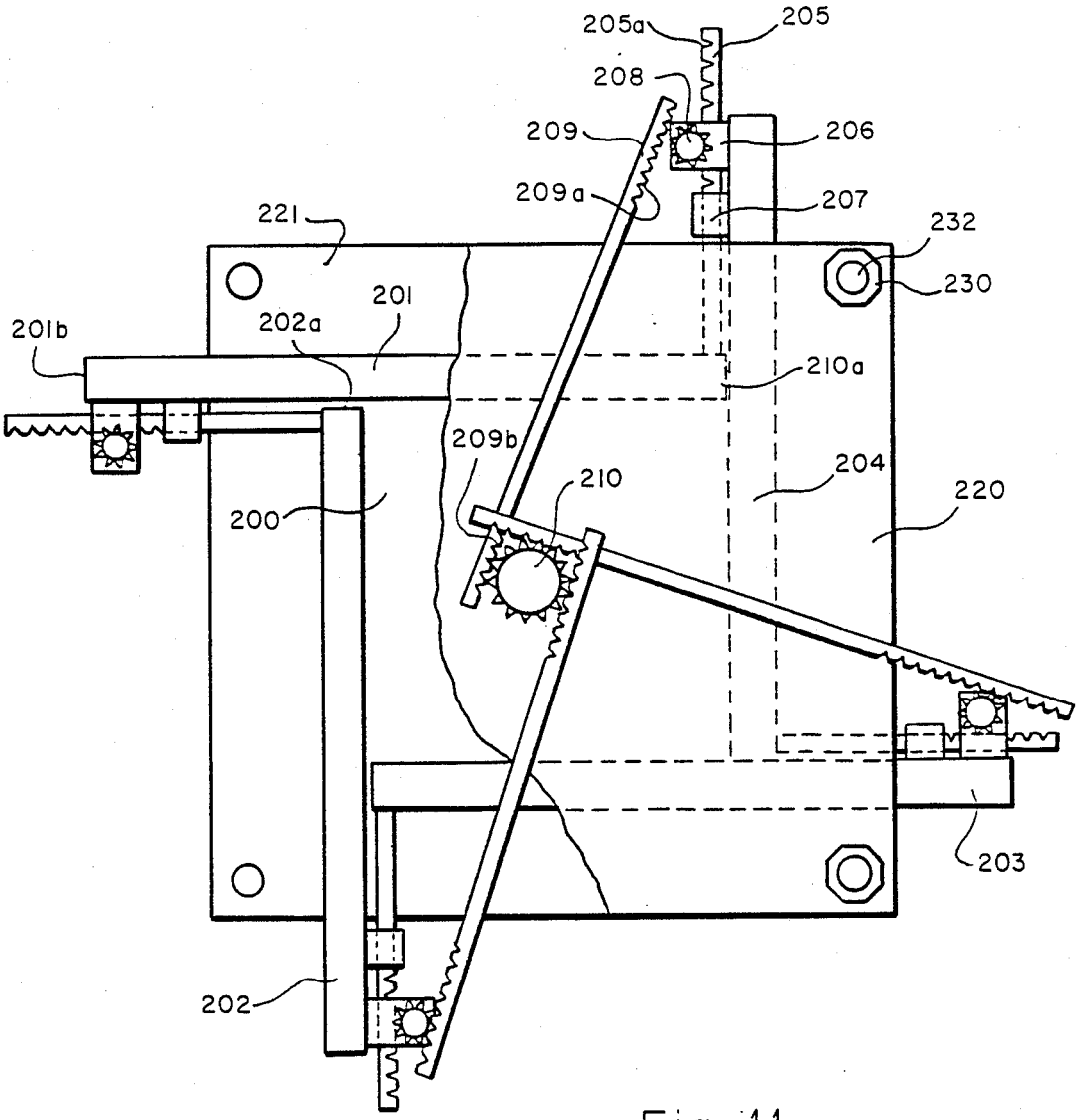
FIG. 11 is a front, elevational view cut-away view of still another alternative embodiment of the apparatus of the invention.

FIG. 11 depicts still another embodiment of an internal combustion engine of the invention. In this embodiment, a chamber 200 is defined by movable walls 201, 202, 203, and 204. The walls are relatively thin and are substantially rigid, being sufficiently rigid to withstand the forces of the combustion process.

Each wall is defined by two ends. Looking at wall 201, one end 201*a* is adjacent wall 204 and is in slidable moving contact with relationship thereto. On the outside surface of wall 201, near the end 201*a*, is mounted an elongated extension means 205. The elongated extension means 205 is conveniently in a shape of a rod, although other shapes which accomplish the same purpose may also be suitably employed. The extension means 205 is substantially parallel to the adjacent wall 204 and provides reciprocal linear motion in response to the movement of wall 201.

With regard to the movement of wall 201 with respect to wall 204, it will be seen that wall 204 is provided with two collars 206 and 207 for retaining the extension means 205 in the desired relationship to wall 204. Further, collar 206 is provided with a gear 208 interior the collar for engaging teeth 205*a*, which are formed on one side of the extension means 205. Near the other end 201*b* of wall 201 are means for supporting an elongated extension from adjacent wall 202 and means for translating the reciprocal linear motion of the extension means to rotary motion.

Each wall 201, 202, 203, 204 is thus provided with similar elongated extension means, and means for supporting the extension means and for translating reciprocal linear motion into rotary motion.

Associated with each rotary translation means 208 is a means for coupling the rotary motion derived from the each movable wall 201, 202, 203, 204 into synchronous rotary motion. This is accomplished by another extension means 209, also conveniently a rod, provided with teeth 209*a* and 209*b* at each end, which engage gear 208 at end 209*a* and common gear 210 at end 209*b*. Crankshaft 210, which supports gear 210*a*, is connected through rod 211 to a smaller crankshaft 212. Crankshaft 212 rotated and is connected to the wheels of the vehicle.

In operation, when extension means 205 moves down or up, it will rotate gear 208. A rotating gear 208 moves extension means 209, which couples the rotary motion of gear 208 to rotary motion of the crankshaft 210. Crankshaft 210 is much like a pendulum in that it moves back and forth in response to the movement of extension member 209. Connection through rod 211 to a smaller crankshaft 212 will cause the crankshaft 212 to rotate, instead of swinging back and forth like crankshaft 210.

A means to permit gases to selectively enter and exit from the combustion chamber 200 is provided by a pair of inlet and exhaust valves 214 and 215, respectively, disposed in a stationary sidewall 221 and opening inwardly through sidewall 221 to provide inlet and exhaust ports 217 and 218, respectively, for gases contained in the combustion chamber 200.

An ignition means to selectively ignite gases placed in the combustion chamber 200 is provided by a spark plug 219 secured in the stationary sidewall 221, having conventional spark gap terminals extending through the sidewall 221 and into the combustion chamber 200.

Fixed walls 220 and 221, together with movable walls 201, 201, 203, and 204, define the combustion chamber 200.

Walls 220 and 221 are maintained in spaced apart relationship by rods 232, which are fastened by means of springs 231 and nuts 230. In this manner, pressure is applied to the plates 220, 221 to ensure proper attachment between the plates 220, 221, 201, 202, 203, 204, so that a proper seal of chamber 200 may be achieved.

Other preferred embodiments of the apparatus of the invention include having the combustion chamber constructed in a form of a triangular-shaped enclosure such as shown in FIG. 14, wherein numbers 200' through 208' inclusive are similar to those elements designated by numbers 201 through 208 described above.

The foregoing embodiment is simple and economical to manufacture. The contact area between moving parts is minimal, and can be reduced even more by reducing the thickness of plates 201, 202, 203, 204 to a very thin dimension so long as the material is hard and rigid enough so that the plates will not bend under the forces of combustion. Finally, any torque that occurs during combustion occurs outside the combustion chamber itself at collars 206 and 207 and their counter-parts on the other walls.

In operation, this embodiment is quite similar to that of the first embodiment described above. Further, two or more such combustion chambers may be operatively associated with a single crankshaft to provide the equivalent of multi-piston operation, also as described above in connection with FIG. 2.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the examples of the invention herein disclosed for the purpose of illustration which do not constitute departures from the spirit and scope of the invention.

I CLAIM:

1. An internal combustion engine comprising:

a combustion chamber formed by a conformable bladder member capable of conforming in conformance with internal combustive forces in an outward expanding direction and of resuming its normal state thereafter;

said bladder member surrounded by a confined liquid medium contained in a closed receptable;

piston means operatively connected to said closed receptacle activated by the pressure exerted through the liquid medium by said bladder member in its expanded state to move in reciprocal action capable of driving a crankshaft;

a hollow casing received in the interior of said bladder member having a plurality of holes therethrough to permit outward expanding combustive forces to pass therethrough to expand said bladder member;

ignition means secured in said hollow casing adapted to selectively ignite a gas contained in said combustion chamber; and means for permitting said gas to selectively enter into and exit from said combustion chamber.

2. The internal combustion engine as defined by Claim 1 wherein said ignition means secured in said hollow casing adapted to selectively ignite a gas contained in said combustion chamber is a spark plug having the spark gap terminals thereof extending into said hollow housing.

3. The internal combustion engine as defined by Claim 2 wherein said means for permitting said gas to selectively enter into and exit from said combustion chamber is a pair of inlet and exhaust valves disposed in said combustion chamber and opening inwardly thereinto.

* * * * *